United States Patent [19]

Rothstein

[11] Patent Number: 4,517,814

[45] Date of Patent: May 21, 1985

[54] APPARATUS FOR CONTINUOUS DIRECT TREATMENT OF PRODUCTS BY MEANS OF A FLUID COOLING MEDIUM

[75] Inventor: Sven O. Rothstein, Ängelholm, Sweden

[73] Assignee: Frigoscandia Contracting AB, Sweden

[21] Appl. No.: 568,101

[22] Filed: Jan. 4, 1984

[30] Foreign Application Priority Data

Jan. 12, 1983 [SE] Sweden ..... 8300135

[51] Int. Cl.[3] ..... F25D 17/02

[52] U.S. Cl. ..... 62/374; 62/380

[58] Field of Search ..... 62/63, 64, 374, 375, 62/380

[56] References Cited

U.S. PATENT DOCUMENTS

| | | | |
|---|---|---|---|
| 2,287,825 | 6/1942 | Postlewaite | 62/64 |
| 2,677,248 | 5/1954 | Rexford et al. | 62/63 |
| 3,114,248 | 12/1963 | Morrison | 62/64 |
| 3,115,756 | 12/1963 | Overbye | 62/57 |
| 3,512,370 | 5/1970 | Murphy et al. | 62/64 |
| 3,605,427 | 9/1971 | Rudy | 62/64 |
| 3,605,428 | 9/1971 | Smith et al. | 62/64 |
| 3,611,737 | 10/1971 | Alaburda et al. | 62/63 |
| 3,871,186 | 3/1975 | Wagner | 62/64 |

FOREIGN PATENT DOCUMENTS

| | | |
|---|---|---|
| 7906969 | 1/1983 | Sweden . |
| 362949 | 8/1983 | Sweden . |

*Primary Examiner*—Ronald C. Capossela

*Attorney, Agent, or Firm*—Shapiro and Shapiro

[57] ABSTRACT

An apparatus for continuous direct treatment of products by means of a fluid cooling medium comprises a chamber adapted to permit passage of the products. According to the invention this chamber is provided in its bottom plane with two slots spaced from each other in the direction of movement, to which slots the fluid cooling medium is adapted to be supplied in such a way that curtains will be formed at the slots, said curtains defining, together with sidewalls arranged on the sides of the bottom plane, a liquid bed formed of the fluid cooling medium on the bottom plane. The conveying means for the product consists of a perforate endless conveyor belt adapted to travel along the bottom plane of the chamber for moving the product through the liquid bed in order to effect the direct treatment of the product by means of the fluid cooling medium.

4 Claims, 2 Drawing Figures

APPARATUS FOR CONTINUOUS DIRECT TREATMENT OF PRODUCTS BY MEANS OF A FLUID COOLING MEDIUM

The present invention relates to an apparatus for continuous direct treatment of products by means of a fluid cooling medium, said apparatus comprising a chamber adapted to permit passage of the products. Characteristic of the apparatus is that the chamber is provided in its bottom plane with two slots or the like spaced from each other in the direction of movement, to which slots the fluid cooling medium is adapted to be supplied in such a way that curtains will be formed at the slots, said curtains defining, together with sidewalls arranged on the sides of the bottom plane, a liquid bed formed of the fluid cooling medium on the bottom plane, the conveying means for the product consisting of a perforate endless conveyor belt adapted to travel along the bottom plane of the chamber for moving the product through the liquid bed in order to effect the direct treatment of the product by means of the fluid cooling medium.

The invention will be described more fully below with reference to the accompanying drawing which illustrates the apparatus and in which.

Figure 1:
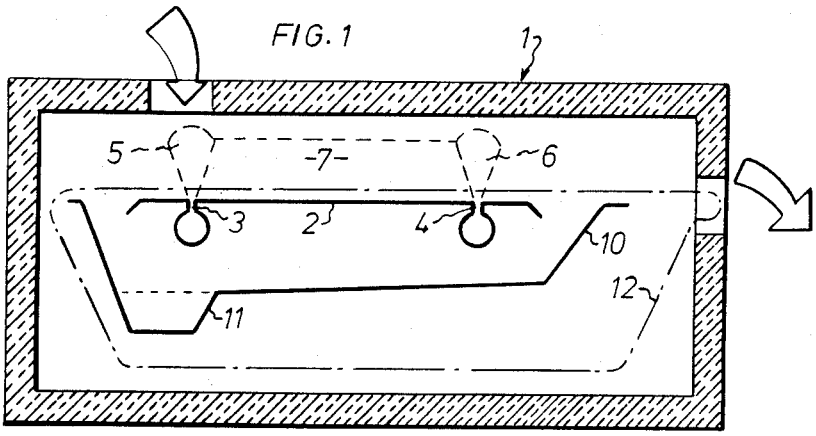
FIG. 1 is a schematic longitudinal sectional view of the apparatus.

The apparatus shown in FIG. 1 is arranged in a cooling chamber 1 which is adapted to permit passage of the products, as indicated by arrows. The chamber 1 has in its bottom plane 2 two slots 3 and 4 or the like spaced from each other in the direction of movement, to which slots the fluid cooling medium is adapted to be supplied in such a way that curtains 5 and 6 will be formed at the slots 3 and 4 to define a liquid bed 7 formed of the fluid cooling medium on the bottom plane 2 between said curtains.

Figure 2:
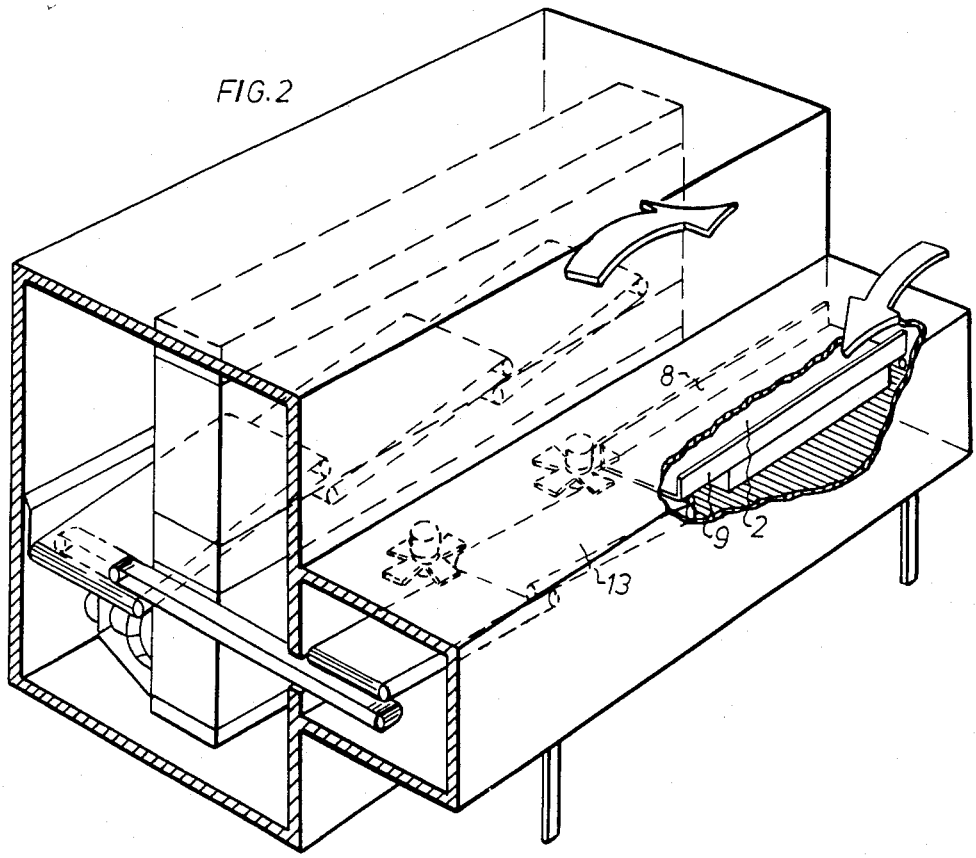
FIG. 2 is a perspective view of a freezing plant including the apparatus according to the invention.

The chamber is also provided with sidewalls 8 and 9 on the sides of the bottom plane 2, which walls define, together with the curtains 5 and 6 formed at the slots 3 and 4, the liquid bed 7. The sidewalls 8 and 9 are apparent from FIG. 2.

The bottom plane 2 is located above a container 10 for collection of fluid cooling medium flowing away from the plane. As the cooling medium flows away from the forward and rear ends of the bottom plane 2 the container 10 must extend beyond these two ends. The container 10 is provided with a bottom trough 11 to permit recirculation of the fluid cooling medium.

As appears from the dash-dotted line in FIG. 1 the apparatus is provided with an endless conveyor belt 12 for moving the products along the bottom plane 2 of the chamber 1 through the liquid bed 7. In order that the conveyor belt 12 should not prevent the formation of the liquid curtains 5 and 6 it is perforate.

The supply of products may be achieved in various ways depending on the nature of the products and the treatment in view. Thus the products may be supplied before the liquid curtain 5 or after it directly into the liquid bed 7.

The apparatus according to the invention is primarily intended for use in freezing food products and the like in two stages, the liquid cooling medium consisting of liquid nitrogen or the like. The first stage is effected in the apparatus according to the invention, in which the surface of the products first is frozen by moving the products down for a short time in the liquid cooling medium at a low boiling point. The other stage is effected in a conventional mechanical freezer 13 where the final freezing takes place. As appears from FIG. 2 the mechanical freezer 13 comprises one or more conveyor belts on which the products are treated with flowing cooled air.

Approximately a third, i.e. 30–35%, of the freezing is to take place in the first stage while the remaining freezing is to be achieved in the second stage, which gives good economy.

Due to evaporation only about 50% of the cold contained in the liquid nitrogen can be used in the first stage. The remaining approximately 50%, which consequently is in a gaseous state, can be used for cooling of the products before and/or after the first stage, whereby the cooling medium gas is assumed to give a good result down to about −30° C. The distribution of the cooling medium gas is decided from case to case. Thus it may be used for pre-cooling of the products prior to the direct treatment. It may also be used for cooling down and storage of the frozen products. In certain cases it may be used for the final freezing in the mechanical freezer 13.

The food product to be frozen usually consists of large or small pieces. The small pieces should in the first stage be subjected to surface freezing, extending 0.5–1.0 mm into the product, while large pieces should be subjected to a surface freezing extending slightly deeper into the product, say 2.0 mm. This surface freezing is achieved in a few seconds, say 3–16 seconds, for which reason the invention results in a quick-freezing process which also gives a high quality to the frozen product since the surface of it is not subjected to any drying.

The invention is not restricted to that described above and shown in the drawing but may be modified within the scope of the appended claims.

What I claim and desire to secure by Letters Patent is:

1. Apparatus for continuous direct treatment of products by means of a fluid cooling medium, said apparatus comprising a chamber having means therein for forming a liquid bed of the fluid cooling medium and having means for moving the products through the liquid bed in order to effect direct treatment of the products by the fluid cooling medium, said means for forming said liquid bed comprising a supporting surface beneath the bed, sidewall surfaces at opposite sides of the bed, and means for providing substantially vertically directed curtains of the fluid cooling medium at the ends of the bed for retaining the bed therebetween.

2. Apparatus as claimed in claim 1, wherein said means for providing curtains of said fluid cooling medium at the ends of the bed comprises means for ejecting fluid cooling medium upwardly through respective slots in said supporting surface.

3. Apparatus as claimed in claim 1, wherein said means for moving said products through the liquid bed comprises a perforate endless conveyor belt disposed to travel along said supporting surface.

4. Apparatus as claimed in claim 1, further comprising means disposed beneath said supporting surface for collecting fluid cooling medium that flows off of said supporting surface.

* * * * *